US007590372B2

(12) United States Patent
Chae et al.

(10) Patent No.: US 7,590,372 B2
(45) Date of Patent: Sep. 15, 2009

(54) MULTI-PASS TYPE COLOR IMAGE FORMING APPARATUS

(75) Inventors: Su Kyoung Chae, Seoul (KR); Sung Dae Kim, Suwon-si (KR); Young Min Yoon, Yongin-si (KR); Gun Ho Kim, Seoul (KR)

(73) Assignee: Samsung Electronics Co., Ltd, Suwon-si (KR)

( * ) Notice: Subject to any disclaimer, the term of this patent is extended or adjusted under 35 U.S.C. 154(b) by 176 days.

(21) Appl. No.: 11/857,619

(22) Filed: Sep. 19, 2007

(65) Prior Publication Data

US 2008/0080882 A1 Apr. 3, 2008

(30) Foreign Application Priority Data

Oct. 2, 2006 (KR) ..... 10-2006-0097189

(51) Int. Cl.
*G03G 15/01* (2006.01)

(52) U.S. Cl. ..... 399/228

(58) Field of Classification Search ..... 399/107, 399/119, 167, 222, 226, 227, 228
See application file for complete search history.

(56) References Cited

U.S. PATENT DOCUMENTS 5,099,278 A 3/1992 Sato
5,495,327 A * 2/1996 Inomata ..... 399/228
5,579,092 A 11/1996 Isobe et al.
5,809,380 A * 9/1998 Katakabe et al. ..... 399/227
7,428,396 B2 * 9/2008 Kim ..... 399/222
7,457,567 B2 * 11/2008 Kishigami ..... 399/227

FOREIGN PATENT DOCUMENTS

JP 2000-242059 9/2000

OTHER PUBLICATIONS

Chinese Office Action issued May 8, 2009 in CN Application No. 200710151844.6.

* cited by examiner

*Primary Examiner*—Hoan H Tran
(74) *Attorney, Agent, or Firm*—Stanzione & Kim, LLP

(57) ABSTRACT

A multi-pass type color image forming apparatus. The multi-pass type color image forming apparatus includes an indicating member which is provided at a camshaft and has a plurality of indicating portions, a sensing part which detects the plurality of indicating portions, and a control unit which receives a signal from the sensing part when the indicating member passes by the sensing part by the rotation of the camshaft, and determines a home position by a rotational position of the camshaft when a signal pattern from a sequence of signals from the sensing part corresponds with a preset reference pattern. Accordingly, the home position of the camshaft can be determined in a short amount of time regardless of the slip between the cams and the push caps, so that the warm up time can be shortened and the generation time of noise caused by the contact between the cams and the push caps can be minimized. Also, the reliability about the home position of the camshaft can be increased, thereby transmitting the power timely to the correct developing device.

13 Claims, 12 Drawing Sheets

MULTI-PASS TYPE COLOR IMAGE FORMING APPARATUS

CROSS-REFERENCE TO RELATED APPLICATIONS

This application claims the benefit of Korean Patent Application No. 2006-0097189, filed on Oct. 2, 2006 in the Korean Intellectual Property Office, the disclosure of which is incorporated herein in its entirety by reference.

BACKGROUND OF THE INVENTION

1. Field of the Invention

The present general inventive concept relates to a multi-pass type color image forming apparatus, and more particularly, to a multi-pass type color image forming apparatus which is provided with one photosensitive drum and one exposure unit, forms a color toner image on an intermediate transfer member by repeating exposure, development and transfer with respect to respective colors, and transfers and fixes the color toner image on a recording medium, such as, a paper.

2. Description of the Related Art

Generally, a color image forming apparatus using an electrophotographic process is configured such that a light beam is scanned to a photosensitive member charged with a certain electric potential to form an electrostatic latent image thereon. The electrostatic latent image is developed to a toner image by using a certain color toner, and the toner image is transferred and fixed to a paper to form a color image.

Color of the toner used in the color image forming apparatus generally includes yellow (Y), magenta (M), cyan (C) and black (K). Accordingly, in order to adhere the four-color toner to the electrostatic latent image, four developing devices are needed.

A color image forming process is classified into a single pass process which is equipped with four exposure units and four photosensitive members, and a multi-pass process which is equipped with a single exposure unit and a single photosensitive member.

A multi-pass type color image forming apparatus includes one photosensitive drum and one exposure unit, and is configured such that exposure, development and transfer are repeated with respect to respective colors to form a color toner image on an intermediate transfer member, and the color toner image is transferred and fixed to a paper.

In such a multi-pass type color image forming apparatus, four developing devices get power from a driving motor. All four developing devices are not necessarily driven at the same time, and are selectively driven according to the color image.

In such a multi-pass type color image forming apparatus, four developing devices are sequentially operated. It is preferable that only a developing roller of the selected developing device (e.g., Y) is rotated, and developing rollers of the remaining developing devices (e.g., M, C and K) are not rotated.

To this end, a conventional multi-pass type color image forming apparatus includes a power transmission device for selectively transmitting a driving force from a driving motor to four developing devices, and a cam device for operating the power transmission device so that the driving force is transmitted to the selected developing device as a cam provided at a camshaft is rotated.

However, in operating the cam device, a slip is generated between the cam device and the power transmission device so that the driving force cannot be transmitted timely to the selected developing device or the driving force is transmitted to the wrong developing device.

SUMMARY OF THE INVENTION

The present general inventive concept provides a multi-pass type color image forming apparatus which can transmit a driving force timely and reliably to respective developing devices.

Additional aspects and utilities of the present general inventive concept will be set forth in part in the description which follows and, in part, will be obvious from the description, or may be learned by practice of the general inventive concept.

The foregoing and/or other aspects and utilities of the present general inventive concept are achieved by providing a multi-pass type color image forming apparatus including a photosensitive drum, a laser scanning unit, a driving motor, a plurality of developing devices, a cam device which has a camshaft that rotates by the driving motor and a plurality of cams provided at the camshaft corresponding to the developing devices, and a power transmission device which is provided between the developing devices and the cam device and selectively transmits a rotational force from the driving motor to the developing devices according to a rotational phase of the driving motor, including an indicating member which is provided at the camshaft and has a plurality of indicating portions; a sensing part which detects the plurality of indicating portions, and a control unit which receives a signal from the sensing part when the indicating member passes by the sensing part by the rotation of the camshaft, and determines a home position by a rotational position of the camshaft when a signal pattern from a sequence of signals from the sensing part accords with a preset reference pattern.

The indicating member can have two indicating portions which are spaced apart from each other by a predetermined distance in a circumferential direction on an outer periphery of the indicating member and protrude in the circumferential direction.

The control unit can receive the signal from the sensing part while controlling the camshaft to be intermittently rotated.

The control unit can receive the signal from the sensing part while controlling the camshaft to be continuously rotated.

The control unit can determine the home position by the rotational position of the camshaft when the signal pattern from a sequence of signals from the sensing part is changed into a pattern of $0 \rightarrow 0 \rightarrow 1 \rightarrow 0$.

The foregoing and/or other aspects and utilities of the present general inventive concept are also achieved by providing a multi-pass type color image forming apparatus, including a driving motor to drive a camshaft based on a signal received, an actuator device to selectively engage the driving motor with the camshaft to operate a plurality of color developing units, a control unit to generate a signal to activate the driving motor and to activate the actuator device based on a control signal, and a sensing device to determine a rotational position of the camshaft and to generate and transmit the control signal to the control unit based on the determination.

The foregoing and/or other aspects and utilities of the present general inventive concept are achieved by providing a method of operating a developing unit of a multi-pass type color image forming apparatus, the method including determining a rotational position of a rotating camshaft and generating a control signal based on the determination and selectively engaging or disengaging a driving motor of the camshaft based on the generated control signal.

The foregoing and/or other aspects and utilities of the present general inventive concept are achieved by providing method of operating a developing device of a multi-pass type color image forming apparatus, the method including sensing a rotational position of a camshaft of the developing device to operate individual developing units thereof, generating and transmitting a control signal based on the sensing, and selectively engaging or disengaging a driving motor with the camshaft based on the control signal.

BRIEF DESCRIPTION OF THE DRAWINGS

These and/or other aspects and utilities of the present general inventive concept will become apparent and more readily appreciated from the following description of the embodiments, taken in conjunction with the accompanying drawings, of which.

DETAILED DESCRIPTION OF THE PREFERRED EMBODIMENTS

Figure 1:
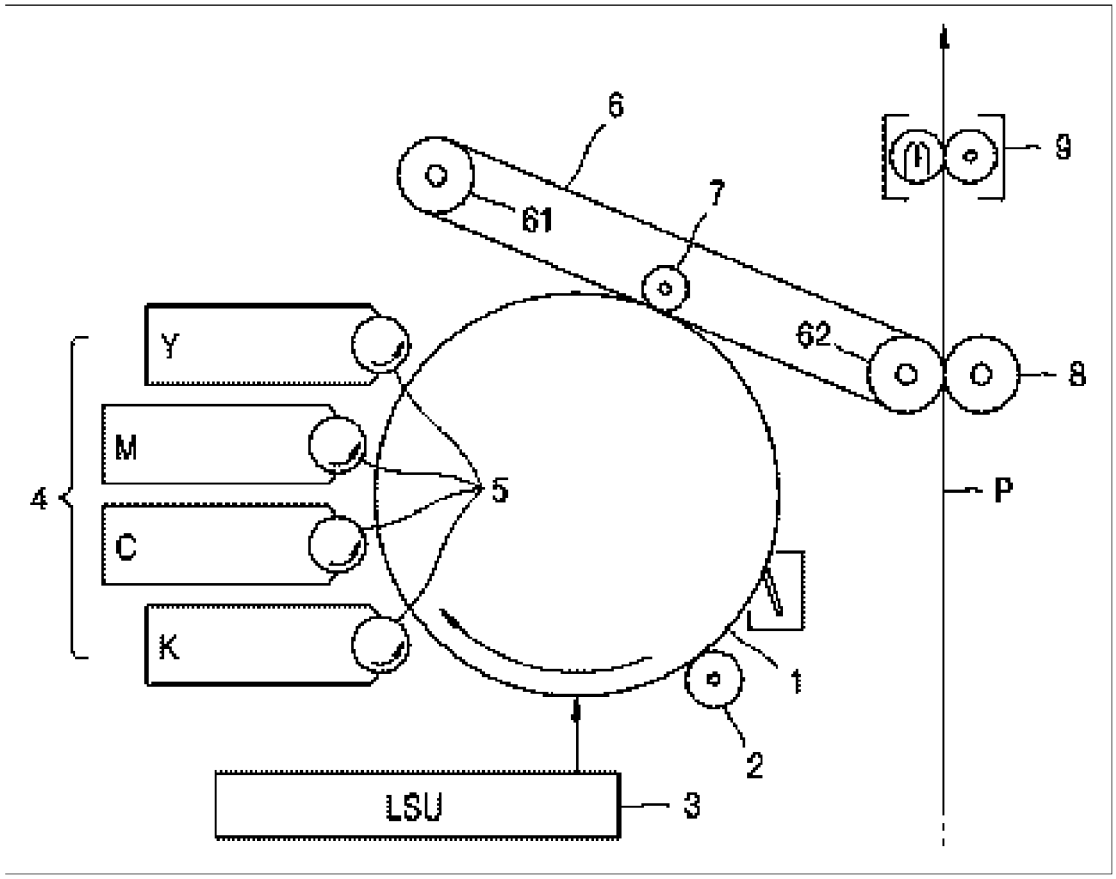
FIG. 1 is a schematic constitutional view illustrating a multi-pass type color image forming apparatus in accordance with an exemplary embodiment of the present general inventive concept.

Reference will now be made in detail to exemplary embodiments of the present general inventive concept, examples of which are illustrated in the accompanying drawings, wherein like reference numerals refer to like elements throughout. The embodiments are described below to explain the present general inventive concept by referring to the figures.

As illustrated in FIG. 1, a multi-pass type color image forming apparatus in accordance with an exemplary embodiment of the present general inventive concept includes a photosensitive drum 1, a charge roller 2, an exposure unit 3, developing devices 4, an intermediate transfer belt 6, a first transfer roller 7, a second transfer roller 8, and a fixing device 9.

The photosensitive drum 1 can be a cylindrical metallic drum which is coated with a photoconductive layer on a circumference.

The charge roller 2 can charge the photosensitive drum 1 with a uniform electric potential. The charge roller 2 can be rotated in contact or non-contact with the outer peripheral surface of the photosensitive drum 1 to supply an electric charge, to thereby charge the outer peripheral surface of the photosensitive drum 1 with a uniform electric potential.

The exposure unit 3 can scan a light beam corresponding to image information to the photosensitive drum 1 that is charged with a uniform electric potential to form an electrostatic latent image. The exposure unit 3 generally includes a laser scanning unit (LSU) which uses a laser diode as a light source.

In order to print the color image, the multi-pass type color image forming apparatus of this embodiment uses a yellow (Y) toner, a magenta (M) toner, a cyan (C) toner and a black (K) toner. Accordingly, four developing devices 4 are provided to respectively contain the yellow (Y) toner, the magenta (M) toner, the cyan (C) toner and the black (K) toner.

The developing devices 4 are respectively provided with developing rollers 5. The developing devices 4 are positioned such that the developing rollers 5 are spaced from the photosensitive drum 1 by a development gap to perform a non-contact type development. The development gap can be in the range of several tens of microns to several hundreds of microns. The developing devices 4 may further include supply rollers (not illustrated) to supply the toner to the developing rollers 5, and agitators (not illustrated).

The intermediate transfer belt 6 can be supported by support rollers 61 and 62, so as to run at the same linear velocity as the rotational velocity of the photosensitive drum 1. A length of the intermediate transfer belt 6 can be the same as or larger than a length of a paper P (or other recording medium) of the maximum size which is used in the multi-pass type color image forming apparatus.

The first transfer roller 7 is disposed opposite to the photosensitive drum 1. A first transfer bias is applied to the first transfer roller 7 to transfer the toner image developed on the photosensitive drum 1 to the intermediate transfer belt 6.

The second transfer roller 8 is disposed opposite to the intermediate transfer belt 6. While the toner image is transferred to the intermediate transfer belt 6 from the photosensitive drum 1, the second transfer roller 8 is spaced apart from the intermediate transfer belt 6. When the toner image is completely transferred to the intermediate transfer belt 6, the second transfer roller 8 comes into contact with the intermediate transfer belt 6 with a specific pressure. A second transfer bias is applied to the second transfer roller 8 to transfer the toner image to the paper P.

Hereinafter, a color image forming process of the multi-pass type color image forming apparatus structured as above will be described. Firstly, the light beam corresponding to the image information of yellow (Y) color, for example, is scanned from the exposure unit 3 to the photosensitive drum 1 charged with a uniform electric potential by the charge roller 2. The electrostatic latent image corresponding to the image of yellow (Y) color is formed on the photosensitive drum 1. The development bias is applied to the developing roller 5 of the yellow developing device 4Y. Then, the toner of yellow (Y) color is adhered to the electrostatic latent image, and the toner image of yellow (Y) color is developed on the photosensitive drum 1. The toner image of yellow (Y) color is transferred to the intermediate transfer belt 6 by the first transfer bias applied to the first transfer roller 7. When the toner image of yellow (Y) color for one page is completely transferred, the exposure unit 3 scans the light beam corresponding to the image information of magenta (M) color, for example, to the photosensitive drum 1 re-charged with a uniform electric potential by the charge roller 2, to form the electrostatic latent image corresponding to the image of magenta (M) color. The magenta developing device 4M supplies the toner of magenta (M) color to the electrostatic latent image to develop the same. The toner image of magenta (M) color formed on the photosensitive drum 1 is transferred to the intermediate transfer belt 6 so as to be overlapped on the toner image of yellow (Y) color which has already been transferred. By repeating the above process with respect to cyan (C) and black (K), the color toner image in which the toner images of yellow (Y), magenta (M), cyan (C) and black (K) colors are overlapped is formed on the intermediate transfer belt 6. The color toner image is transferred to the paper P which passes between the intermediate transfer belt 6 and the second transfer roller 8 by the second transfer bias. The fixing device 9 fixes the color toner image to the paper by applying heat and pressure to the color toner image.

As described above, the multi-pass type color image forming apparatus according to this embodiment is configured such that four developing devices 4 are sequentially operated. The developing roller 5 of the selected developing device (e.g., 4Y) is applied by the development bias. On the other hand, the developing rollers 5 of the remaining developing devices (e.g., 4M, 4C and 4K) are not applied by the development bias, or are applied by the development-prevention bias to prevent the development of the toner. Also, it is preferable that only the developing roller 5 of the selected developing device (e.g., 4Y) is rotated, and the developing rollers 5 of the remaining developing devices (e.g., 4M, 4C and 4K) are not rotated. To this end, the multi-pass type color image forming apparatus according to this embodiment includes a power transmission device to selectively transmit a driving force from a driving motor to four developing devices 4, and a cam device to operate the power transmission device.

Figure 2:
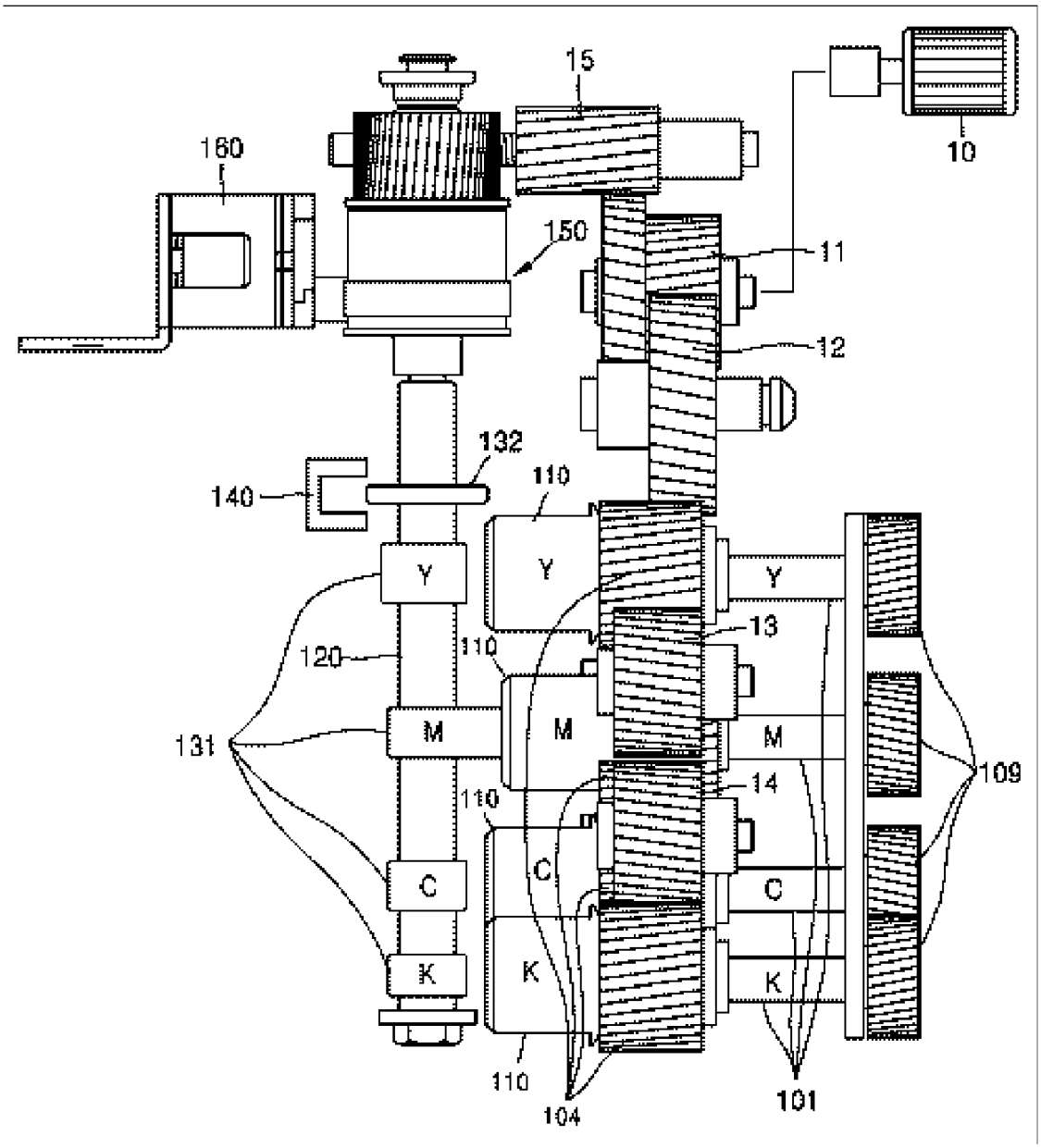
FIG. 2 is a constitutional view illustrating a power transmission device of a multi-pass type color image forming apparatus in accordance with an exemplary embodiment of the present general inventive concept.
Figure 3:
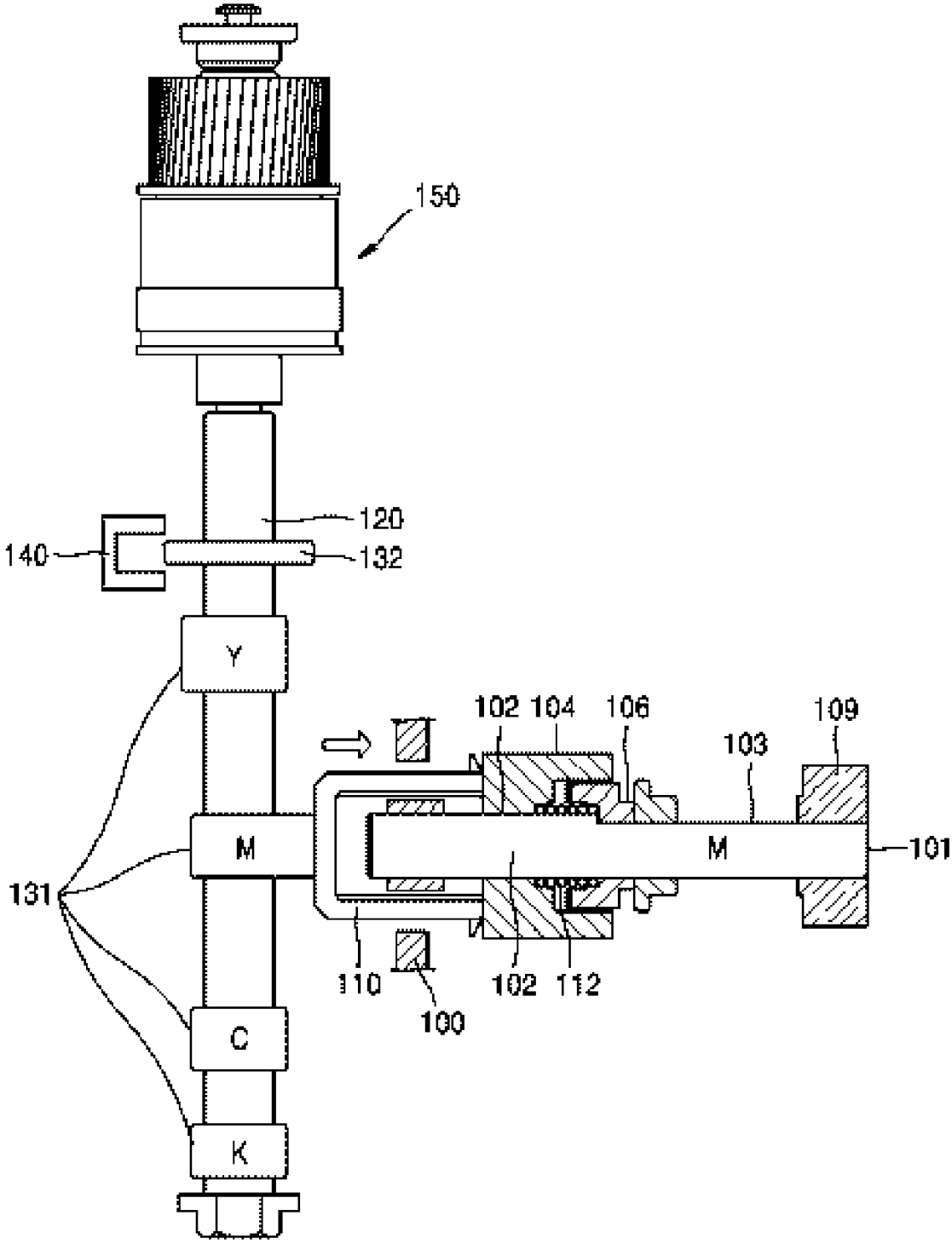
FIG. 3 is a fragmentary sectional view of FIG. 2.
Figure 4:
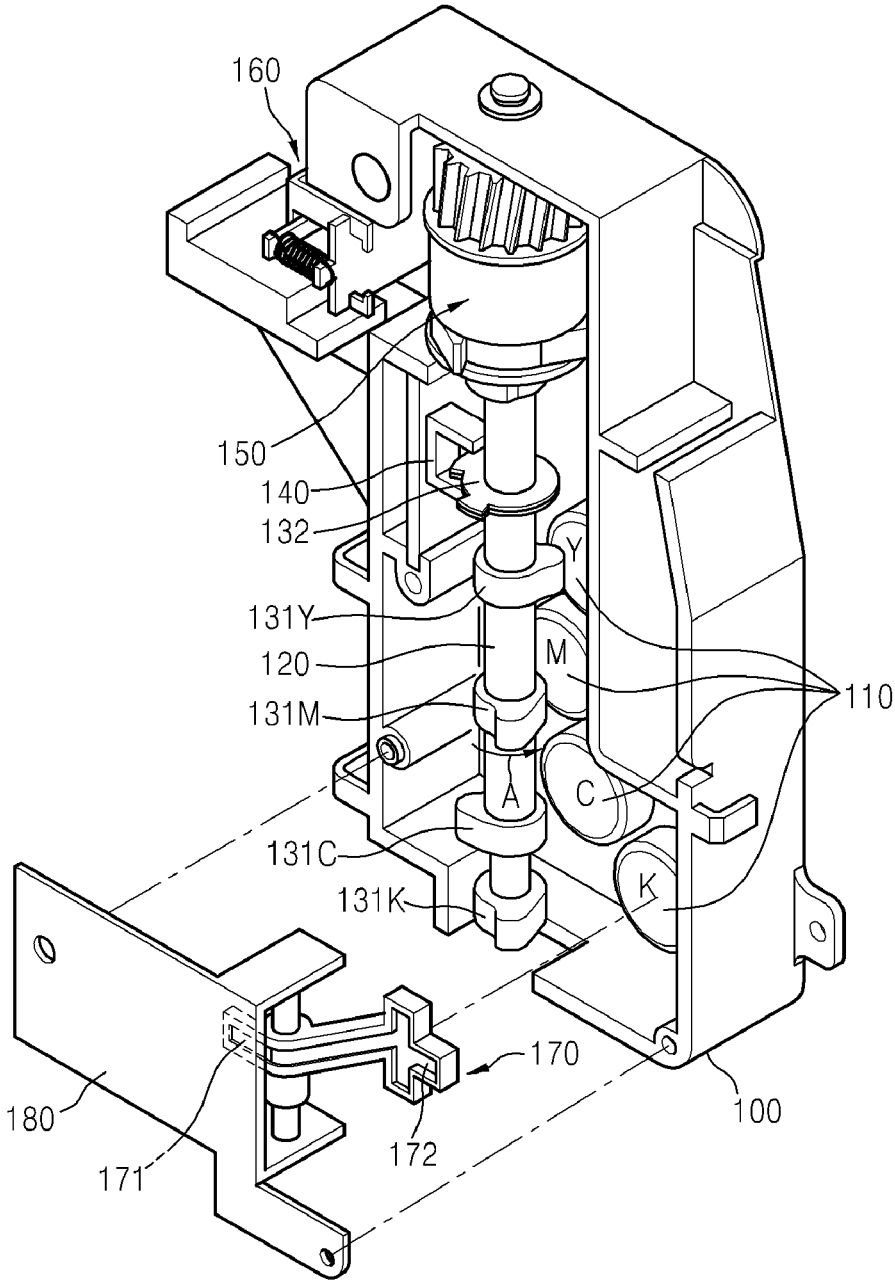
FIG. 4 is a rear perspective view of FIG. 2.
Figure 5:
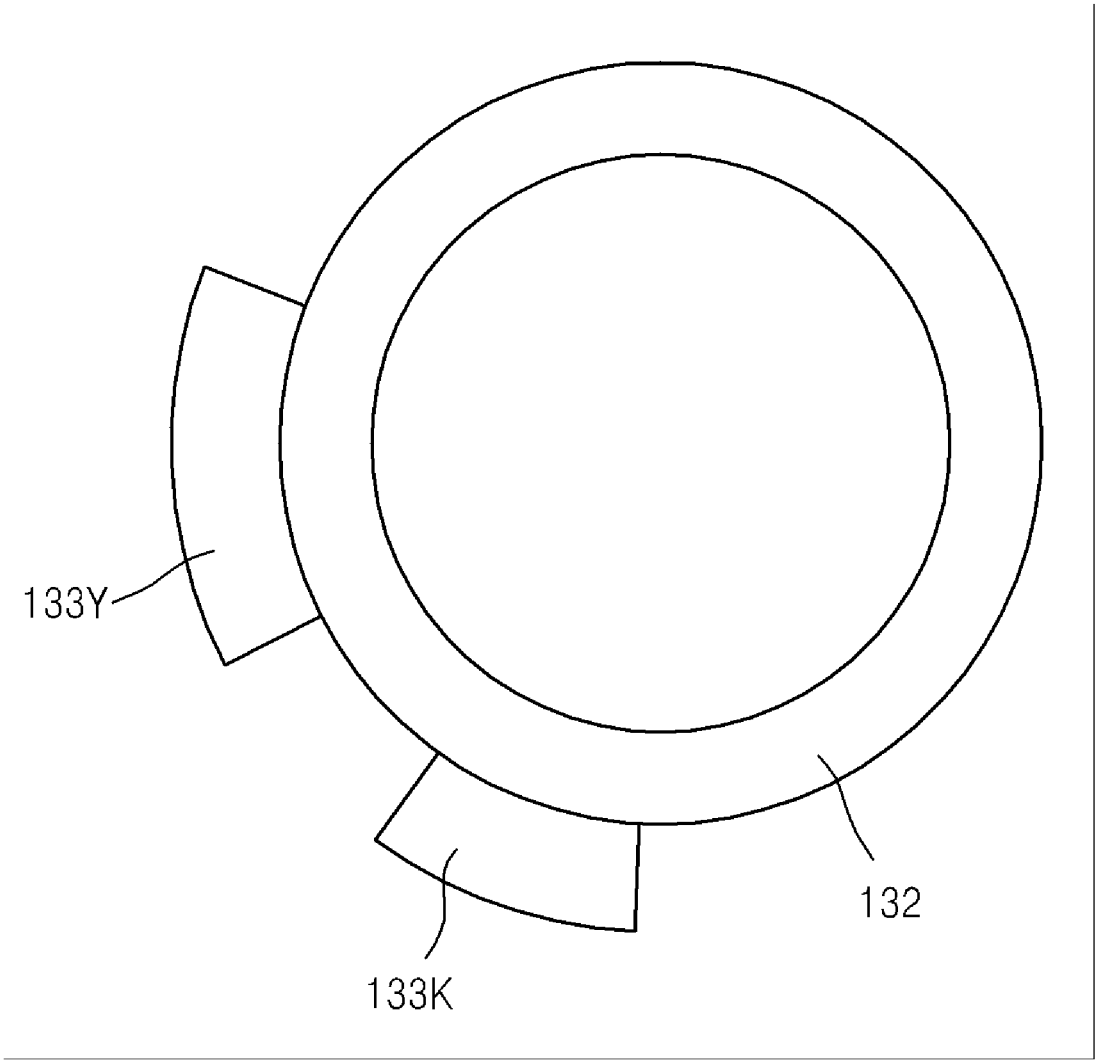
FIG. 5 is a sectional view of an indicating member in FIG. 4.
Figure 6:
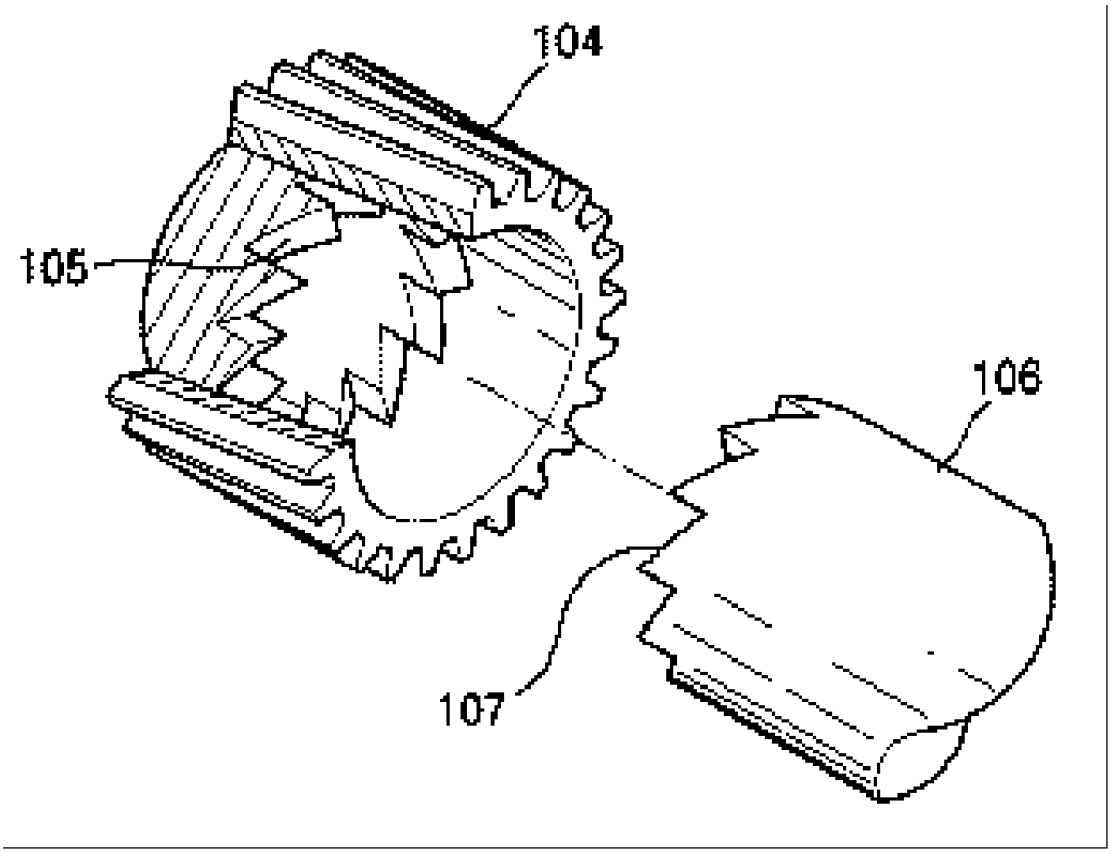
FIG. 6 is a perspective view of a sliding hub and a fixing hub in FIG. 2.

FIG. 2 is a constitutional view illustrating the power transmission device of the multi-pass type color image forming apparatus in accordance with an exemplary embodiment of the present general inventive concept, FIG. 3 is a fragmentary sectional view of FIG. 2, FIG. 4 is a rear perspective view of FIG. 2, FIG. 5 is a sectional view of an indicating member in FIG. 4, and FIG. 6 is a perspective view of a sliding hub and a fixing hub in FIG. 2

Referring to FIGS. 2 through 6, four shafts 101 are rotatably mounted to a bracket 100. Each of the shafts 101 is provided with a cylinder portion 102 and a surface cutting portion 103. The cylinder portion 102 is coupled with a sliding hub 104. The surface cutting portion 103 is coupled with a fixing hub 106 on one end and a driving gear 109 on the other end. An elastic member 112 elastically biases the sliding hub 104 away from the fixing hub 106. As illustrated in FIG. 2, the sliding hub 104Y is connected to the driving motor 10 through gears 11 and 12. The sliding hub 104Y and the sliding hub 104M are connected to each other through a gear 13. The sliding hub 104C is connected to the driving motor 10 through a plurality of gears (not illustrated). The sliding hub 104C and the sliding hub 104K are connected to each other through a gear 14. As illustrated in FIG. 6, the sliding hub 104 and the fixing hub 106 are respectively provided with complementary engagement portions 105 and 107. Accordingly, if the sliding hub 104 is engaged with the fixing hub 106, the driving force of the driving motor 10 is transmitted to the fixing hub 106, and the shaft 101 and the driving gear 109 are rotated. The driving gear 109 is connected to a driven gear (not illustrated) provided at the developing device 4. The driven gear is connected to the developing roller 5 and other components mounted inside the developing device 4.

By the above structure, four sliding hubs 104 are selectively slid to be engaged with four fixing hubs 106, thereby selectively driving four developing devices 4.

Referring to FIG. 4, the multi-pass type color image forming apparatus according to this embodiment is provided with a cam device to selectively slide four sliding hubs 104. The cam device includes a camshaft 120 and four cams 131.

Four cams 131 are fixed to the camshaft 120 at positions corresponding to four sliding hubs 104. The four cams 131 and the camshaft 120 can be formed by a plastic injection molding in an integral manner. The four cams 131 have different phases. When the camshaft 120 is rotated, the four cams 131 sequentially push the four sliding hubs 104 to be sequentially engaged with corresponding four fixing hubs 106.

The multi-pass type color image forming apparatus according to this embodiment is further provided with four push caps 110. The cams 131 push the push caps 110 to slide the sliding hubs 104.

The cams 131 can have a locus capable of smoothly engaging the sliding hubs 104 with the fixing hubs 106, and disengaging the sliding hubs 104 from the fixing hubs 106 as promptly as possible.

Referring to FIG. 4, the cams 131Y, 131M and 131C can directly push the push caps 110Y, 110M and 110C, respectively. But, because the cam 131K is disposed apart from the push cap 110K, the cam 131K cannot directly push the push cap 110K. Therefore, a connecting member 170 to connect the cam 131K and the push cap 110K is provided. The connecting member 170 is pivotably coupled to a cover 180, and the cover 180 is coupled to the bracket 100. If the cam 131K pushes a first end portion 171 of the connecting member 170, the connecting member 170 is swiveled, and a second end portion 172 of the connecting member 170 pushes the push cap 110K.

To this end, the cams 131Y, 131M, 131C and 131K are arranged as illustrated in FIG. 4. The cams 131M and 131C respectively have phase differences of 90 degrees and 180 degrees from the cam 131Y in a reverse direction to a rotational direction A of the camshaft 120. The cam 131K operates the connecting member 170 to push the push cap 110K. The first end portion 171 of the connecting member 170 is located in an opposite direction of the push cap 110K. Accordingly, the cam 131K has a phase difference of 270 degrees from the cam 131C in a reverse direction of the rotational direction A of the camshaft 120.

As illustrated in FIGS. 2 and 3, the camshaft 120 is rotated by the driving motor 10. The rotational force of the driving motor 10 is intermittently transmitted to the camshaft 120. The image forming apparatus includes a spring clutch 150 to intermit the rotational force transmitted to the camshaft 120 from the driving motor 10, and an actuator 160 to selectively operate the spring clutch 150.

Figure 7:
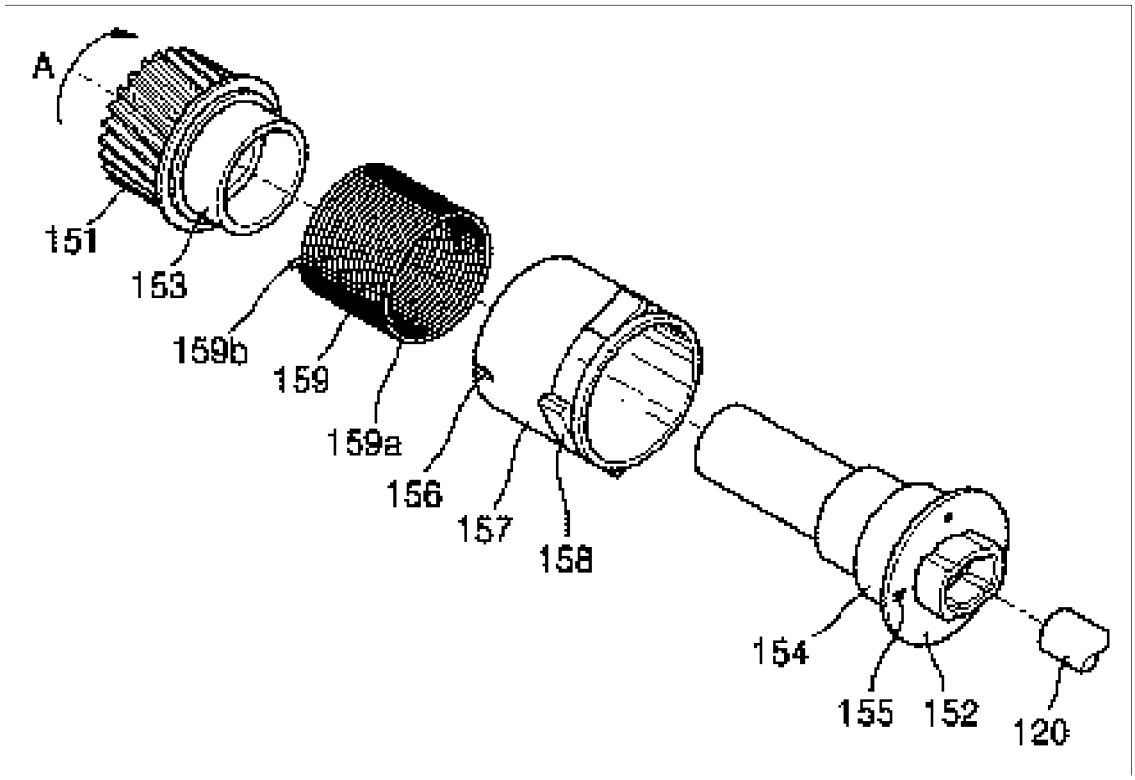
FIG. 7 is an exploded perspective view of a spring clutch of FIG. 2.
Figure 8:
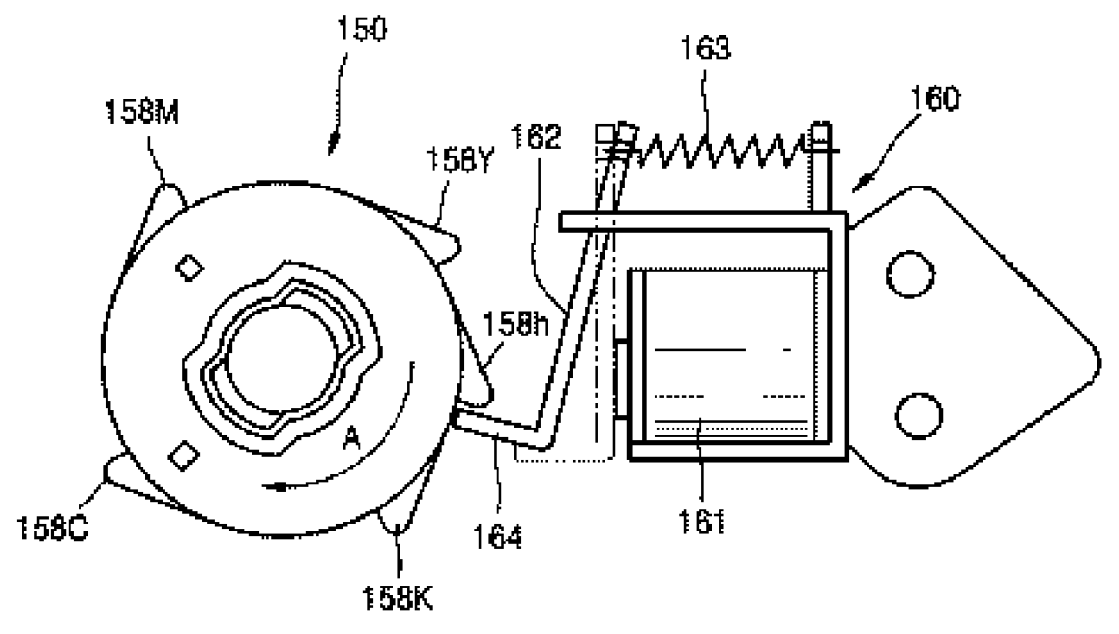
FIG. 8 is a schematic view illustrating an operation of a spring clutch and an actuator in FIG. 2.

FIG. 7 is an exploded perspective view of the spring clutch 150 depicted in FIG. 2, and FIG. 8 is a schematic view illustrating an operation of the spring clutch and the actuator depicted in FIG. 2.

Referring to FIGS. 7 and 8, the spring clutch 150 includes a clutch gear 151, a clutch spring 159, a clutch hub 157 and a bushing 152.

The bushing 152 is fixed to an end of the camshaft 120, and the clutch gear 151 is rotatably coupled to the bushing 152.

The clutch spring 159 is inserted by cylinder portions 153 and 154 of the clutch gear 151 and the bushing 152.

The clutch hub 157 surrounds the clutch spring 159. The clutch hub 157 is provided with four coupling portions 158Y, 158M, 158C and 158K which correspond in phase to four cams 131, and a single home position coupling portion 158*h*. A first end 159*a* and a second end 159*b* of the clutch spring 159 are respectively inserted into insertion holes 155 and 156 which are provided at the bushing 152 and the clutch hub 157, respectively. The clutch gear 151 is connected to a gear 15 (see FIG. 2) which is rotated by the driving motor 10. The clutch gear 151 is rotated in a direction of an arrow A shown in FIG. 7 by the driving motor 10.

The clutch spring 159 is contractingly twisted to reduce an inner diameter thereof, so as to tightly hold the cylinder portions 153 and 154 of the clutch gear 151 and the bushing 152. Accordingly, when the clutch gear 151 is rotated in the direction of the arrow A (FIG. 7), the clutch spring 159 and the bushing 152 are rotated, and the camshaft 120 is also rotated together therewith. Because the second end 159*b* of the clutch spring 159 is inserted into the insertion hole 156 of the clutch hub 157, the clutch hub 157 is also rotated.

When electric current is not applied to a coil part 161, as illustrated by a real line in FIG. 8, a stopper 164 of a moving rod 162 is moved forward, so that the coupling portions 158 are caught by the stopper 164 and the rotation of the clutch hub 157 is prevented.

As illustrated in FIG. 7, because the second end 159*b* of the clutch spring 159 is inserted into the insertion hole 156 of the clutch hub 157, if the clutch hub 157 is not rotated, the clutch spring 159 is expandingly twisted to enlarge the inner diameter thereof. As the force with which the clutch spring 159 holds the cylinder portion 153 of the clutch gear 151 is weakened, the inner peripheral portion of the clutch spring 159 slips over the cylinder portion 153 of the clutch gear 151, and the clutch spring 159 and the bushing 152 are not rotated. Accordingly, the rotation of the camshaft 120 is stopped.

If electric current is applied to the coil part 161, as illustrated by a dotted line in FIG. 8, the moving rod 162 adheres to the coil part 161, and the stopper 164 is moved away from the coupling portions 158. Then, as described above, the clutch gear 151 and the camshaft 120 are rotated together.

Referring to FIGS. 2, 3 and 5, in order to check an initial position of the camshaft 120, the camshaft 120 is provided with an indicating member 132.

The indicating member 132 is provided with a plurality of indicating portions 133H and 133Y (e.g., two indicating portions) which protrude at different lengths on a circumference of the indicating member 132. For instance, the indicating portion 133H is a home position indicating portion, and the indicating portion 133Y is a yellow-color indicating portion. The home position indicating portion 133H and the yellow-color indicating portion 133Y are spaced apart from each other by a predetermined distance in a circumferential direction on the outer periphery of the indicating member 132.

The bracket 100 is provided with a sensing part 140 to detect (sense) two indicating portions 133H and 133Y. The sensing part 140 can be an optical sensor. Before the indicating portions 133H and 133Y pass by the sensing part 140, the sensing part 140 outputs a "0." When the indicating portions 133H and 133Y pass by the sensing part 140, the sensing part 140 outputs a "1."

The clutch hub 157 is provided with a plurality of coupling portions 158Y, 158M, 158C, 158K and 158*h* (e.g., five coupling portions) corresponding to the indicating member 132.

If the stopper 164 of the actuator 160 comes into contact with one of the coupling portions 158Y, 158M, 158C, 158K and 158*h*, the rotation of the camshaft 120 is stopped at the home position or at each of the development positions (yellow (Y), magenta (M), cyan (C) and black (K)).

At this time, the home position refers to the non-driving state of four developing devices 4, i.e., the state in which all four sliding hubs 104 are disengaged from the corresponding fixing hubs 106. Accordingly, the home position coupling portion 158*h* is not overlapped in phase with any of the four coupling portions 158Y, 158M, 158C and 158K.

If electric current applied to the actuator 160 is interrupted when the indicating portions 133H and 133Y are detected by the sensing part 140, the moving rod 162 is located at a position illustrated by the real line in FIG. 8.

If the camshaft 120 is rotated and one of the coupling portions 158Y, 158M, 158C, 158K and 158*h* is caught by the stopper 164, the rotational force from the driving motor 10 is interrupted, and the rotation of the camshaft 120 is stopped at the home position or at one of the development positions. FIG. 8 illustrates the state in which the home position coupling portion 158*h* is caught by the stopper 164, and thus the camshaft 120 is stopped at the home position.

Figure 9:
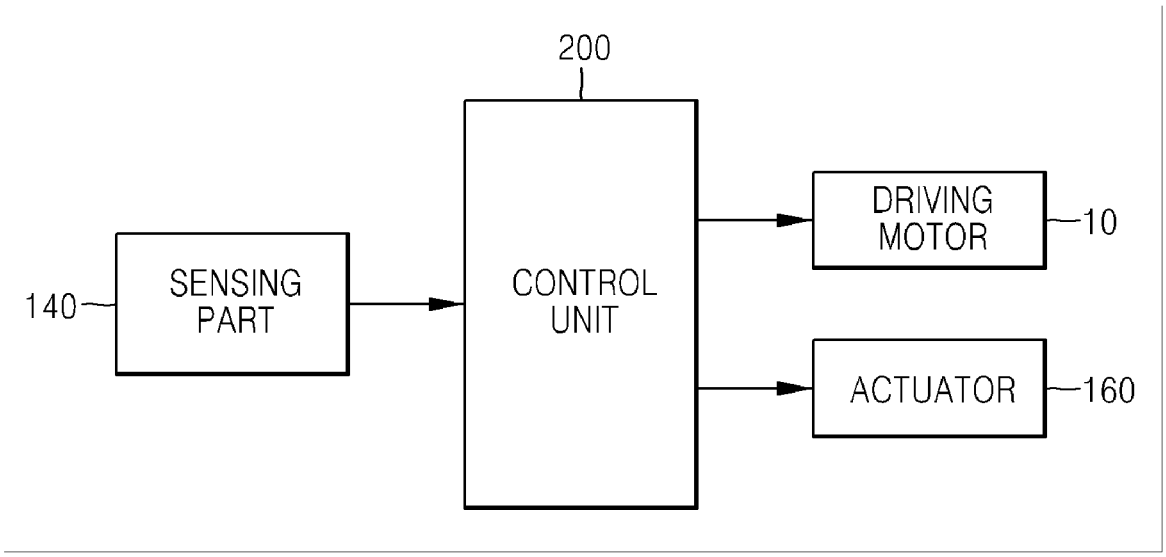
FIG. 9 is a control block diagram of a multi-pass type color image forming apparatus in accordance with an exemplary embodiment of the present general inventive concept.

FIG. 9 is a control block diagram of the multi-pass type color image forming apparatus in accordance with an exemplary embodiment of the present general inventive concept. As illustrated in FIG. 9, the multi-pass type color image forming apparatus of this embodiment further includes a control unit 200 to control the overall operation of the apparatus. The control unit 200 is electrically connected to the sensing part 140 at an input part, and electrically connected to the driving motor 10 and the actuator 160 at an output part.

The control unit 200 supplies electric power to the actuator 160 to operate the same. If electric power is supplied to the actuator 160, the moving rod 162 becomes adhered to the coil part 161 (the position illustrated by the dotted line in FIG. 8), and the coupling portions 158 go into a state of freely moving.

The control unit 200 drives the driving motor 10 to rotate the camshaft 120. According to the rotation of the camshaft 120, the indicating member 132 is also rotated, and two indicating portions 133H and 133Y of the indicating member 132 pass by the sensing part 140.

In response to the signal from the sensing part 140 when the indicating member 132 passes by the sensing part 140 by the rotation of the camshaft 120, the control unit 200 determines the home position of the camshaft 120.

Figure 10:
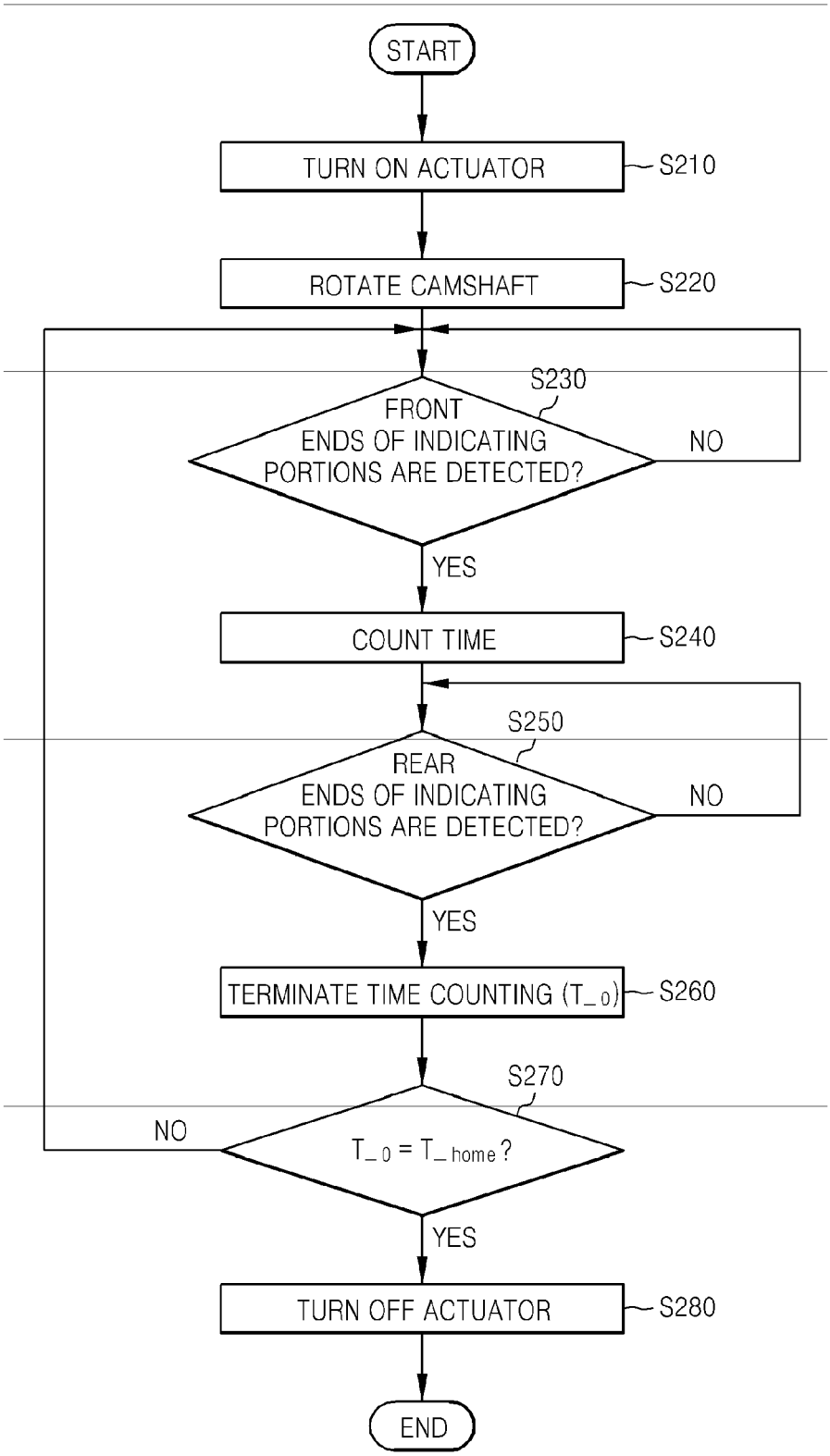
FIG. 10 is a flow chart of a method of determining a home position of a camshaft in a multi-pass type color image forming apparatus in accordance with an exemplary embodiment of the present general inventive concept.

FIG. 10 is a flow chart of a method of determining the home position of the camshaft in the multi-pass type color image forming apparatus in accordance with an exemplary embodiment of the present general inventive concept.

Referring to FIG. 10, the control unit 200 supplies electric power to the actuator 160 to turn on the same at operation S210. If the electric power is supplied to the actuator 160, the moving rod 162 of the actuator 160 becomes adhered to the coil part 161 (the position illustrated by the dotted line in FIG. 8), and five coupling portions 158Y, 158M, 158C, 158K and 158*h* go into a state of freely moving.

The control unit 200 drives the driving motor 10 to rotate the camshaft 120 at operation S220. As the camshaft 120 is rotated, the indicating member 132 is also rotated. Accordingly, as the indicating member 132 is rotated, two indicating portions 133H and 133Y of the indicating member 132 pass by the sensing part 140.

When the indicating member 132 is rotated, the control unit 200 determines whether the sensing part 140 detects front ends of the indicating portions 133H and 133Y at operation S230. At this time, before the front ends of the indicating portions 133H and 133Y pass by the sensing part 140, the sensing part 140 outputs a "0." When the front ends of the indicating portions 133H and 133Y pass by the sensing part 140, the sensing part 140 outputs a "1."

If it is determined that the sensing part 140 does not detect the front ends of the indicating portions 133H and 133Y at operation S230, the control unit 200 continuously determines whether the front ends of the indicating portions 133H and 133Y are detected. If it is determined that the sensing part 140 detects the front ends of the indicating portions 133H and 133Y, the control unit 200 counts the time until rear ends of the indicating portions 133H and 133Y are detected since the front ends of the indicating portions 133H and 133Y are detected at operation S240.

The control unit 200 determines whether the sensing part 140 detects the rear ends of the indicating portions 133H and 133Y at operation S250. At this time, before the rear ends of the indicating portions 133H and 133Y pass by the sensing part 140, the sensing part 140 outputs the "1." When the rear ends of the indicating portions 133H and 133Y pass by the sensing part 140, the sensing part 140 outputs the "0."

If it is determined that the sensing part 140 does not detect the rear ends of the indicating portions 133H and 133Y at operation S250, the control unit 200 continuously determines whether the rear ends of the indicating portions 133H and 133Y are detected. If it is determined that the sensing part 140 detects the rear ends of the indicating portions 133H and 133Y, the control unit 200 terminates the time counting at operation S260. The counted time T_0 is a time elapsed until the rear end of one of the indicating portions 133H and 133Y passes by the sensing part 140 after the front end of one of the indicating portions 133H and 133Y passes by the sensing part 140.

The control unit 200 determines whether the counted time T_0 is equal to a time T_home which is taken for the home position indicating portion 133H to pass by the sensing part 140 at operation S270. The time T_home taken for the home position indicating portion 133H to pass by the sensing part 140 is measured in advance and stored in the control unit 200.

If it is determined that the time T_0 is not equal to the time T_home at operation S270, the process goes to operation S230. On the other hand, If it is determined that the time T_0 is equal to the time T_home at operation S270, the control unit 200 turns off the actuator 160 at operation S280. If the actuator 160 is turned off, the moving rod 162 is returned to the position illustrated by the real line in FIG. 8 by the elastic force of the spring 163, and the home position coupling portion 158*h* is caught by the stopper 164. Accordingly, the camshaft 120 is located at the home position.

From the state in which the camshaft 120 is located at the home position, the camshaft 120 is moved to the respective development positions according to the development control, and the electrostatic latent images of yellow (Y), magenta (M), cyan (C) and black (K) colors are formed on the photosensitive drum 1.

The above method has features of counting the time since the front ends of the indicating portions 133H and 133Y are detected by the sensing part 140 until the rear ends of the indicating portions 133H and 133Y are detected by the sensing part 140, comparing the counted time with the pre-stored time taken for the home position indicating portion 133H to pass by the sensing part 140, and determining that the position when the counted time is equal to the pre-stored time is the home position of the camshaft 120.

When rotating the camshaft 120 in order to determine the home position of the camshaft 120, the cams 131Y, 131M, 131C and 131K contact the push caps 110Y, 110M, 110C and 110K and push them by the rotation of the camshaft 120. However, when the cams 131Y, 131M, 131C and 131K are released from the push caps 110Y, 110M, 110C and 110K, slip may be generated, and so the camshaft 120 may be rotated instantly faster than the original rotational speed. Accordingly, because the time taken for the indicating portions 133H and 133Y to pass by the sensing part 140 is not constant, it may be difficult to accurately determine the home position of the camshaft 120.

In another embodiment of the present general inventive concept, there is a method to increase the reliability in determining the home position of the camshaft 120 in the shortest amount of time regardless of a slip between the cams 131Y, 131M, 131C and 131K and the push caps 110Y, 110M, 110C and 110K, so that a warm up time and a noise generation time can be minimized, and a power can be timely transmitted to the correct developing device.

According to this embodiment, in contrast with the method of determining the home position of the camshaft 120 by using the time taken for the indicating member 132 to pass by the sensing part 140, a signal pattern from the sensing part 140 can be detected while the indicating member 132 passes by the sensing part 140.

Hereinafter, the method of determining the home position of the camshaft 120 by using a signal pattern from the sensing part 140 while the indicating member 132 passes by the sensing part 140 will be described.

Different from the configuration of the indicating member 132 depicted in FIG. 5, an indicating member 132 having a yellow-color indicating portion 133Y and a black-color indicating portion 133K can be used.

Figure 11:
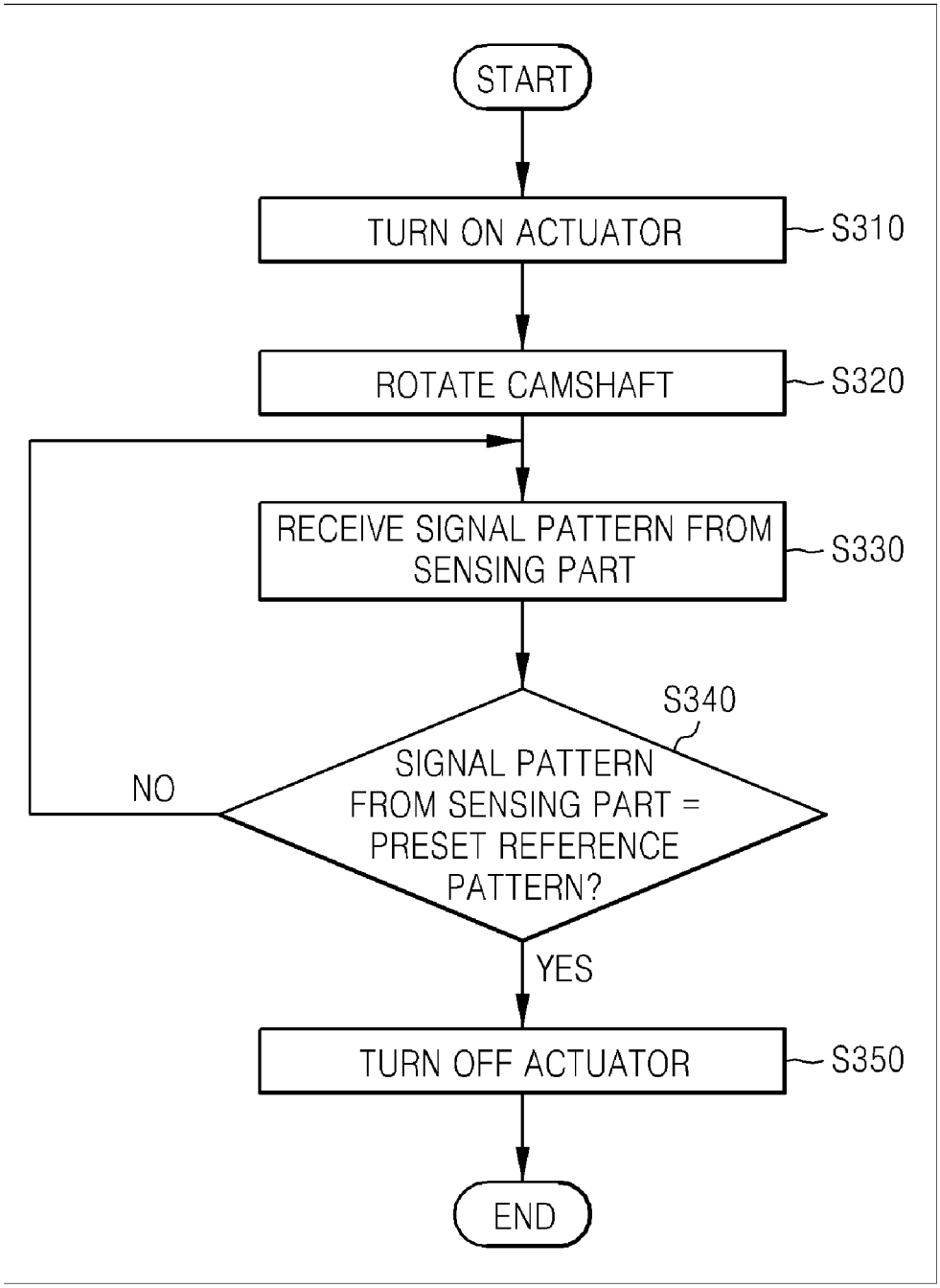
FIG. 11 is a flow chart of a method of determining a home position of a camshaft in a multi-pass type color image forming apparatus in accordance with another exemplary embodiment of the present general inventive concept.

FIG. 11 is a flow chart of a method of determining the home position of the camshaft in the multi-pass type color image forming apparatus in accordance with another exemplary embodiment of the present general inventive concept using a signal pattern from the sensing part 140.

Referring to FIG. 11, the control unit 200 supplies electric power to the actuator 160 to turn on the same at operation S310. If the electric power is supplied to the actuator 160, the moving rod 162 of the actuator 160 becomes adhered to the coil part 161 (the position illustrated by the dotted line in FIG. 8), and five coupling portions 158Y, 158M, 158C, 158K and 158*h* go into a state of freely moving.

The control unit 200 drives the driving motor 10 to rotate the camshaft 120 at operation S320. As the camshaft 120 is rotated, the indicating member 132 is also rotated. Thus, as the indicating member 132 is rotated, the indicating portions of the indicating member 132 pass by the sensing part 140.

While the indicating member 132 is rotated, the control unit 200 receives a signal pattern from the sensing part 140 at operation S330.

Figure 12:
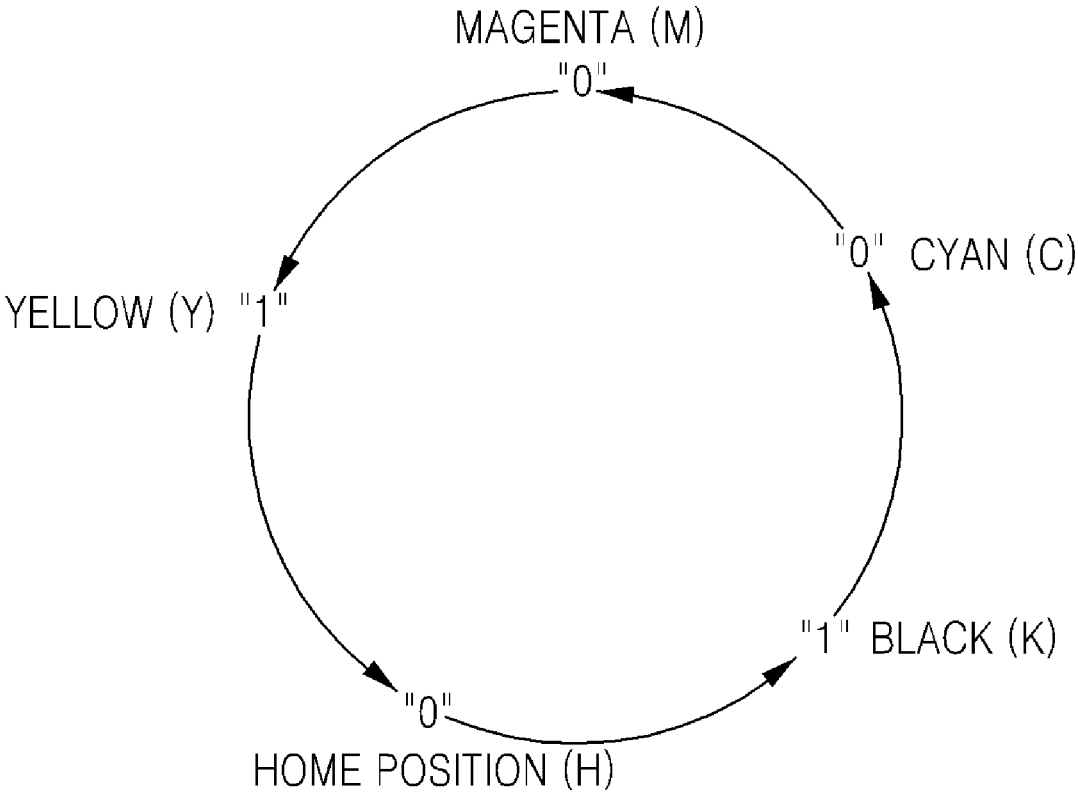
FIG. 12 is a view illustrating a signal pattern from a sensing part in FIG. 11.

The control unit 200 determines whether the signal pattern from the sensing part 140 corresponds with a preset reference pattern at operation S340. As illustrated in FIG. 12, if the indicating member 132 is rotated counterclockwise, a circular loop having an order of yellow (Y), magenta (M), cyan (C), black (K), home position (H), and again yellow (Y) is formed, and such a circular loop passes by the sensing part 140. According to the rotational position of the indicating member 132, the signal pattern from the sensing part 140 is diversely changed for one rotation of the above circular loop. For example, when the output signal from the sensing part 140 has the pattern of 0→0→1→0, the rotational position of the camshaft 120 when the last "0" signal is output becomes the home position H. At this time, the output of the signal from the sensing part 140 in the pattern of 0→0→1→0 is limited to one time while the indicating member 132 is rotated in the range of about two-thirds of a rotation to one and a half rotations.

Accordingly, the signal pattern of 0→0→1→0 is prestored as the reference pattern. The rotational position of the camshaft 120 when the signal pattern from the sensing part 140 accords with the reference pattern is the home position.

For instance, the signal pattern which can be output from the sensing part 140 according to the rotational position of the indicating member 132 may include 1→0→0→1→0, 0→1→0→0→1→0, 1→0→1→0→0→1→0, 0→1→0→1→0→0→1→0, etc. By detecting that the signal pattern from the sensing part 140 is 0→0→1→0, the home position of the camshaft 120 can be easily determined.

If it is determined that the signal pattern from the sensing part 140 corresponds with the preset reference pattern at operation S340, the control unit 200 turns off the actuator 160 at operation S350. If the actuator 160 is turned off, the moving rod 162 is returned to the position illustrated by the real line in FIG. 8 by an elastic force of the spring 163, and the home position coupling portion 158*h* is caught by the stopper 164. When the home position coupling portion 158*h* is caught by the stopper 164, the rotational force transmitted to the camshaft 120 from the driving motor 10 is interrupted by the spring clutch 150, and the rotation of the camshaft 120 is stopped. Accordingly, the camshaft 120 becomes located at the home position.

From the state in which the camshaft 120 is located at the home position, the camshaft 120 is moved to the respective development positions according to the development control, and the electrostatic latent images of yellow (Y), magenta (M), cyan (C) and black (K) colors are formed on the photosensitive drum 1.

The above described method of FIG. 11 using the signal pattern minimizes or eliminates slipping between the cams 131Y, 131M, 131C and 131K and the push caps 110Y, 110M, 110C and 110K.

Another embodiment of the present general inventive concept provides a method of overcoming slipping between the cams 131Y, 131M, 131C and 131K and the push caps 110Y, 110M, 110C and 110K is to detect the signal from the sensing part 140 while one of the coupling portions 158Y, 158M, 158C, 158K and 158*h* is caught by the stopper 164 of the actuator 160 by turning on the actuator 160 for a constant time, and to repeatedly perform the above process with respect to the other coupling portions in the same manner. In other words, the home position of the camshaft 120 is determined based on the signal pattern from the sensing part 140 detected by repeatedly performing the process of detecting the signal from the sensing part 140 by intermittently rotating the camshaft 120 to rotate the indicating member 132 by partial sections.

As apparent from the above description, according to the multi-pass type color image forming apparatus of the present general inventive concept, the home position of the camshaft can be found out in the shortest time regardless of a slip between the cams and the push caps, so that the warm up time can be shortened and the generation time of noise caused by the contact between the cams and the push caps can be minimized.

Also, the reliability about the home position of the camshaft can be increased, thereby transmitting the power timely to the correct developing device.

Although embodiments of the present general inventive concept have been shown and described, it would be appreciated by those skilled in the art that changes may be made in this embodiment without departing from the principles and spirit of the general inventive concept, the scope of which is defined in the claims and their equivalents.

What is claimed is:

1. A multi-pass type color image forming apparatus including a photosensitive drum, a laser scanning unit, a driving motor, a plurality of developing devices, a cam device which has a camshaft to rotate by the driving motor and a plurality of cams provided at the camshaft corresponding to the developing devices, and a power transmission device provided between the developing devices and the cam device and selectively transmits a rotational force from the driving motor to the developing devices according to a rotational phase of the driving motor, comprising:

an indicating member which is provided at the camshaft and has a plurality of indicating portions;

a sensing part which detects the plurality of indicating portions; and a control unit which receives a signal from the sensing part when the indicating member passes by the sensing part by the rotation of the camshaft, and determines a home position by a rotational position of the camshaft when a signal pattern from a sequence of signals from the sensing part corresponds with a preset reference pattern.

2. The multi-pass type color image forming apparatus according to claim 1, wherein the indicating member includes two indicating portions which are spaced apart from each other by a predetermined distance in a circumferential direction on an outer periphery of the indicating member and protrude in a radial direction.

3. The multi-pass type color image forming apparatus according to claim 2, wherein the control unit receives the signal from the sensing part while controlling the camshaft to be intermittently rotated.

4. The multi-pass type color image forming apparatus according to claim 2, wherein the control unit receives the signal from the sensing part while controlling the camshaft to be continuously rotated.

5. The multi-pass type color image forming apparatus according to claim 2, wherein the control unit determines the home position by the rotational position of the camshaft when the signal pattern from a sequence of signals from the sensing part is changed into a pattern of 0→0→1→0.

6. The multi-pass type color image forming apparatus according to claim 1, wherein the control unit receives the signal from the sensing part while controlling the camshaft to be intermittently rotated.

7. The multi-pass type color image forming apparatus according to claim 1, wherein the control unit receives the signal from the sensing part while controlling the camshaft to be continuously rotated.

8. A multi-pass type color image forming apparatus, comprising:

a driving motor to drive a camshaft based on a signal received;

an actuator device to selectively engage the driving motor with the camshaft to operate a plurality of color developing units;

a control unit to generate a signal to activate the driving motor and to activate the actuator device based on a control signal; and a sensing device to determine a rotational position of the camshaft and to generate and transmit the control signal to the control unit based on the determination.

9. The multi-pass type color image forming apparatus according to claim 8, wherein the camshaft comprises indicators around a circumference thereof such that the sensing device generates and transmits the control signal based on a position of each of the indicators.

10. The multi-pass type color image forming apparatus according to claim 9, wherein the indicators correspond with respective ones of the different color developing units and are disposed at predetermined phases around the circumference of the camshaft with respect to each other.

11. The multi-pass type color image forming apparatus according to claim 8, wherein the camshaft comprises indicators around a circumference thereof such that the sensing device generates and transmits the control signal based on a signal pattern of positions of each of the indicators and compares the signal pattern to a pre-stored reference pattern.

12. A method of operating a developing unit of a multi-pass type color image forming apparatus, the method comprising:

determining a rotational position of a rotating camshaft and generating a control signal based on the determination; and selectively engaging or disengaging a driving motor of the camshaft based on the generated control signal.

13. A method of operating a developing device of a multi-pass type color image forming apparatus, the method comprising:

sensing a rotational position of a camshaft of the developing device to operate individual developing units thereof;

generating and transmitting a control signal based on the sensing; and selectively engaging or disengaging a driving motor with the camshaft based on the control signal.

* * * * *